US007066246B2

(12) United States Patent
Pauchet et al.

(10) Patent No.: US 7,066,246 B2
(45) Date of Patent: Jun. 27, 2006

(54) ELECTRICAL CABLE FOR DOWNHOLE APPLICATIONS

(75) Inventors: Frederic Pauchet, Montigny sur Loing (FR); Guy Richard, Dammarie les Lys (FR); Emmanuel Rioufol, Houston, TX (US); Philippe Gambier, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 65 days.

(21) Appl. No.: 10/375,651

(22) Filed: Feb. 26, 2003

(65) Prior Publication Data

US 2003/0159824 A1 Aug. 28, 2003

(30) Foreign Application Priority Data

Feb. 28, 2002 (EP) ..... 02290477

(51) Int. Cl.
*H01B 7/08* (2006.01)

(52) U.S. Cl. ..... 166/65.1; 174/117 F

(58) Field of Classification Search ..... 166/65.1; 174/117 F

See application file for complete search history.

(56) References Cited

U.S. PATENT DOCUMENTS

| | | | | | |
|---|---|---|---|---|---|
| 3,082,292 | A | * | 3/1963 | Gore | 174/117 F |
| 3,663,739 | A | * | 5/1972 | Chevrier | 174/36 |
| 3,775,552 | A | * | 11/1973 | Schumacher | 174/105 R |
| 4,234,759 | A | * | 11/1980 | Harlow | 174/104 |
| 4,262,703 | A | * | 4/1981 | Moore et al. | 138/115 |
| 4,425,475 | A | * | 1/1984 | Ward et al. | 174/117 F |
| 4,625,074 | A | * | 11/1986 | Cox | 174/117 F |
| 5,276,759 | A | | 1/1994 | Nguyen et al. | |
| 5,303,773 | A | * | 4/1994 | Czernichow et al. | 166/66 |
| 5,393,929 | A | * | 2/1995 | Yagihashi | 174/36 |
| 5,467,823 | A | * | 11/1995 | Babour et al. | 166/250.01 |

FOREIGN PATENT DOCUMENTS

EP 0 238 052 B1 11/1992

* cited by examiner

*Primary Examiner*—Hoang Dang
(74) *Attorney, Agent, or Firm*—Victor H. Segura; Brigitte L. Echols

(57) ABSTRACT

An electrical cable for use in a downhole application is provided. The cable includes an elongated support layer and an array of insulated conductors bonded to said elongated support layer. The elongated support layer substantially bears a weight of the conductors.

16 Claims, 4 Drawing Sheets

ELECTRICAL CABLE FOR DOWNHOLE APPLICATIONS

BACKGROUND OF THE INVENTION

1. Field of the Invention

The present invention relates generally to cables and more particularly to cables for use in an earth formation traversed by a borehole.

2. Background Information

Gathering petrophysical, geophysical and well production information using various techniques is well known and widely practiced. Various types of geophysical and petrophysical measurements as well as well production measurements are known in the art. These measurements are typically performed downhole within the earth formation requiring transmission of signals, such as power and data, between the power supply and data acquisition equipment, typically located at the surface, and a downhole sensor by way of which the measurement is performed. The transmission of signals is done through special electrical cables. Such cables have to withstand severe conditions found downhole such as high temperatures, high pressure, shear forces etc.

A conventional cable 100 that may be used in the above applications is shown in FIG. 1. Cable 100 includes a plurality of conductors 102 that conduct signals therethrough. Each conductor is covered with a layer 103 of suitable insulation material. Cable 100 also includes bumper cables 104 positioned on both sides of conductors 102. The conductors 102 and bumper cables 104 are encapsulated by way of a jacket of insulating material 106 that maintains them in place and protects them from interaction with different agents existing downhole. The bumper cables 104 serve the purpose of protecting conductors 102 as well as of supporting the weight of cable 100. Because the depth of the well requires cables that are quite long, these cables may be very heavy and oftentimes cannot support their own weight without the bumper cables.

Cable 100 described above suffers of various disadvantages. The presence of the bumper cables 104 increases the likelihood of a short circuit. Also the bumper cables are quite heavy, making the overall cable heavy. Furthermore, the bumper cables have a relatively large diameter, which makes the size of cable 100 quite large. As the space in the borehole is limited, a larger size cable increases the risk of cable failure due to the various shear forces that may be exerted thereon. It is desirable to provide a cable for use in downhole applications that does not suffer of the above-mentioned disadvantages.

SUMMARY OF THE INVENTION

In one embodiment, the present invention provides an electrical cable for use in a downhole application. The cable includes an elongated support layer and an array of insulated conductors bonded to the elongated support layer. The elongated support layer substantially bears a weight of the conductors.

BRIEF DESCRIPTION OF THE DRAWINGS

The advantages of the present invention will become apparent from the following description of the accompanying drawings. It is to be understood that the drawings are to be used for the purpose of illustration only, and not as a definition of the invention.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In one embodiment, the present invention provides an electrical cable for use in a downhole application. The cable includes an elongated support layer and an array of insulated conductors bonded to the elongated support layer. The elongated support layer substantially bears a weight of the conductors.

Figure 1:
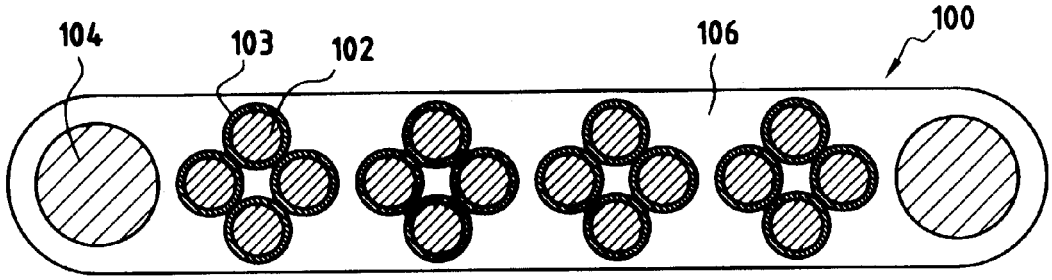
FIG. 1 illustrates a front cross-sectional view through a prior art cable.
Figure 2:
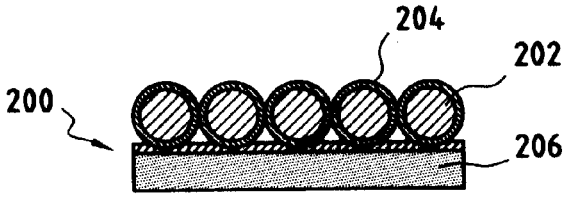
FIG. 2 illustrates a front cross-sectional view through an embodiment of a cable according to the present invention.

FIG. 2 illustrates a front cross-sectional view through an embodiment of an electrical cable 200 (hereinafter referred to as 'cable') for use in downhole applications according to one embodiment of the present invention. Although cable 200 has a flat shape, the present invention is not limited to cables having such shape. The cable 200 includes an array of insulated conductors 202 for transmitting signals such as power and/or data. In one embodiment, each conductor 202 includes a solid copper wire but the present invention is not limited to copper as the sole material of which the conductors may be made, being understood that other conductive materials may be utilized. In one embodiment, each solid wire has a diameter size in a range of gage 16 AWG to 0 AWG, but the present invention is not limited with respect to this range. The solid wires may have diameter sizes that make these wires withstand the current suited to the particular application for which cable 200 is used and thus the electrical power to which the cable is subjected. For example, in an application where cable 200 is used in connection with other devices for determining the resistivity of the earth formation, the current flowing through each conductor 202 may reach 1 Ampere for a voltage of 500 VDC.

Each conductor 202 is electrically insulated by an insulation 204 made of an insulating material. For each conductor 202, insulation 204 encapsulates the respective conductor, coaxially surrounding it along its length. Insulation 204 may also serve the purpose of protecting conductors 202 against the corrosive effects of the fluids existent in the borehole where the cable 200 could be used. Insulation 204 may be formed over conductors 202 by way of conventional extrusion processes.

Possible insulation materials include plastics not susceptible to deformation at high temperatures and pressures such as fluorocarbon polymers including polyvinylidene fluoride, fluorinated ethylene propylene, perfluoroalkoxy (resin), and polytetraflourethylene. Engineered thermoplastics such as polyetheretherketone (PEEK) and polyetherimide, also known as ULTEM, may also be used. These materials may be homopolymers, copolymers or a combination of these specialized materials. Typical thermoplastic materials that may be used include polypropylene and polyethylene. Typical thermosetting materials that may be used include ethylene-propylene-diene monomer terpolymer (EPDM), cross-linked polyethylene and silicone rubber. Thermoplastic materials are typically stronger than thermosetting materials.

Other purpose of insulation 204 is to provide a way of bonding conductors 202 to the elongated support layer 206 along the length of these conductors. Conductors 202 are bonded by way of insulation 204 to the elongated support layer 206 that substantially bears a weight of conductors 202. The weight of these conductors depends on the number of conductors included within the cable. For example, for a cable including 8 conductors, the weight of the cable may be approximately 1 kg per meter of cable. The weight of conductors 202 or a part thereof is transferred to the support layer 206, which supports such weight, particularly when cable 200 is installed in a borehole in a position substantially vertical and the gravity effect on the conductors 202 reaches is at its maximum. The material of which support layer is made, thus, has a tensile strength selected such that it will support the weight of this material as well as the weight of the conductors for a selected depth in the borehole to which the cable extends. Support may also be provided to cable 200 when cable 200 is installed in boreholes not substantially vertical but rather inclined relative to an axis normal to the surface of the earth or even to horizontal boreholes.

In one embodiment, support layer 206 is designed to withstand, among other things: traction loads of approximately 500 kg, temperatures in a range of −50 deg. C. to 175 deg. C., and a pressure equal to the reservoir pressure, which ranges from 5000 Psi to 20000 psi. As the weight of the cable depends on its length, the above mentioned example of support layer designed to support specific values of traction loads should be regarded as illustrative and non-limiting. The length of cable 200 typically equals the length of the well (borehole) along which this cable may be running. Such length could reach or exceed 4000 m, but often this length may be between 1500 m and 2500 m. While cable 200 may be running from a top of the well to the bottom of the well, a shorter cable may be used at the bottom of the well, at the reservoir level, in which case its length could range between 20 m and 500 m.

Support layer 206 may be made of a non-conductive material that provides mechanical strength and support for conductors 202. In one embodiment of the cable according to the present invention, the non-conductive material of which support layer 206 is made has a conductivity of 10 exp7 Ohm*m, but the present invention is not limited in this respect to such conductivity for the support layer. In one embodiment support layer 206 is made of a composite material that includes a fiber and a matrix. The method of making such matrix with fibers is alike any well-known methods of making composite materials that include fibers such as materials for making tennis rackets, gulf clubs, plane wings, boats, etc.

The matrix may be made of a thermoset or thermoplastic material such as PEEK, Epoxy, etc, which provides insulation and protection from the fluids, including oil, water, and gas, which may be found in the borehole. It is preferable that the physical and electrical properties of the support layer 206 remain essentially unaffected by the absorption of such fluids. The fiber may include fiberglass, carbon fiber, Kevlar® fiber, and other types of fibers that have a continuous structure. The fibers which are positioned, in one embodiment, in the matrix along the longitudinal axis of the cable confer the cable more resistance to axial loads. The thickness of the support layer 206 is preferably in the range of 0.05 mm to 3 mm, but the present invention is not limited in this respect to this range of thickness. Cable 200 thus obtained is thinner than conventional cables, more flexible, and stronger on axial loads.

Conductors 202 may be bonded to support layer 206 in different ways; one way to do that is using an adhesive between insulation 204 and the support layer 206. The adhesive may be applied to the surface of the support layer 206 onto which conductors 202 are to be bonded. Conductors 202 are placed onto the applied adhesive, at room temperature, and some pressure is applied. One possible substance that may be used as adhesive is araldite 2014. Other types of adhesive substances able to withstand well-known downhole conditions may equally be used.

Another way of bonding is welding conductors 202 with insulation 204 to support layer 206. In this case, the insulation 204 and the support layer 206 are made of materials that favor bonding therebetween when heated. In one embodiment, both insulation 204 and support layer 206 include PEEK. After conductors 202 are positioned onto support layer 206, these conductors with insulation 204 and support layer 206 are heat cured to a temperature reaching or exceeding the melting point of insulation 204 and support layer 206, and a small pressure is applied. For the embodiment where both insulation 204 and support layer 206 include PEEK, the melting point is approximately 340° C.

The bonding of conductors 202 to support layer 206 may be performed according to one process where the conductors 202 and support layer 206, which are initially spooled on 2 different spoolers, are bonded gradually as they are both un-spooled. The resulting cable is spooled on a different spooler. According to another process, conductors 202 and the support layer 206 are first un-spooled and then bonded and the resulting cable is spooled on a different spooler.

While in one embodiment support layer 206 is made of a non-conductive material, other embodiments could utilize a support layer made of a non-conductive material which, in addition to the array of conductors bonded onto support layer 206, has one or more conductor(s) running through the support layer 206 along its length, provided that this conductor(s) is well insulated from the array of conductors 202. In an alternative embodiment, the array of conductors 206 may be embedded into the support layer 206 instead of being bonded onto support layer 206.

Figure 3:
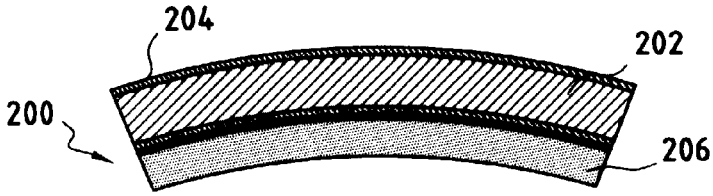
FIG. 3 illustrates a side cross-sectional view through an embodiment of a cable according to the present invention.

FIG. 3 illustrates a side cross-sectional view along the cable 200 of FIG. 2.

Figure 4:
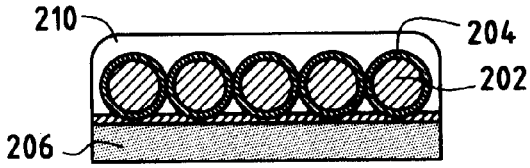
FIG. 4 illustrates a cross-sectional view through the cable of FIG. 2 where the conductors are encapsulated within a protective jacket.
Figure 5:
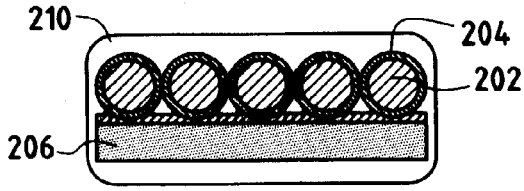
FIG. 5 illustrates a cross-sectional view through the cable of FIG. 2 where the protective jacket has been formed all around the conductors and the elongated support layer.

FIG. 4 illustrates a cross-sectional view through the cable of FIG. 2 where a protective jacket 210 has been formed over the conductors 202 with insulation 204. Protective jacket 210 is provided to seal conductors 202 and insulation 204 to prevent borehole fluids from deteriorating either insulation 204 or electrical conductors 202. The protective jacket 210 may be either formed on top and to the sides of conductors 202 as shown in the figure by a process of molding or it can be extruded around the geometric configuration of the conductors 202 and support layer 206 as shown in FIG. 5 according to standard extrusion techniques. The cable 200 with the extruded material of the protective jacket is then heat-cured such that the protective jacket 210 reaches a hardness in the range of from 40 to 100 Shore A.

The material forming the protective jacket 210 is selected to have a high flexural modulus of elasticity, typically in a range of 0.5 Mpa to 15 MPa at room temperature, but the present invention is not limited to this range for jacket 210. This value of modulus provides stiffness to the cable that further minimizes the stresses applied to the conductors 202 as a result of bending. The jacket may be made of elastomer-type materials such as Nitril rubber (NBR), Hydrogenated Nitril rubber (HNBR), Thermoplastic elastomer (TPE), Nitril , or of other elastomer-type materials or families thereof such as polyurethane based materials. The material forming the protective jacket 210 is chosen to have a melting point temperature at which insulation 204 is not damaged during the molding or extrusion process.

Figure 6:
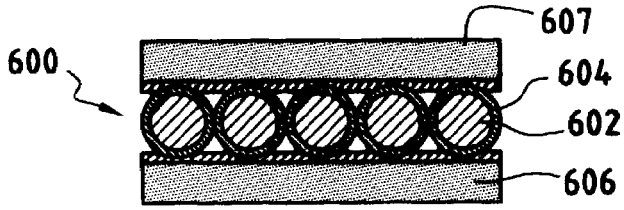
FIG. 6 illustrates a cross-sectional view through an alternative embodiment of a cable where two support layers are utilized.

FIG. 6 illustrates a cross-sectional view through an alternative embodiment of a cable 600 where two support layers 606 and 607 are utilized. The conductors 602 are bonded between support layer 606 and support layer 607. In this embodiment, depending on the material of which the support layers are formed, it may not be needed to utilize a protective jacket as the one shown in FIGS. 4 and 5.

Figure 7:
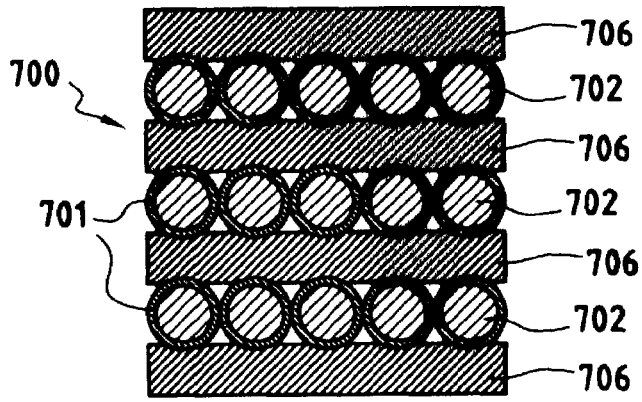
FIG. 7 illustrates a cross-sectional view through an alternative embodiment where the cable includes a plurality of layers of conductors and of protective layers interposed between the layers of conductors.

FIG. 7 illustrates another embodiment where the cable 700 includes a plurality of layers 701 of conductors 702 and of protective layers 706 interposed between the layers of conductors 701.

Figure 8A:
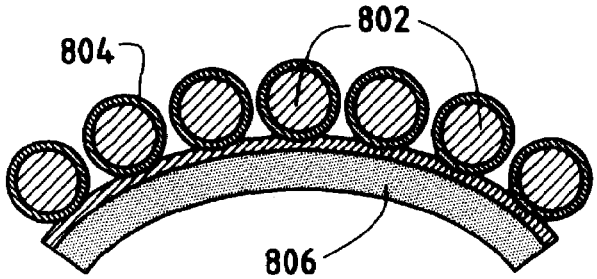
FIGS. 8*a* and 8*b* illustrate a cross-sectional view through the cable of FIG. 2 bent around a longitudinal axis along the length of this cable.
Figure 8B:
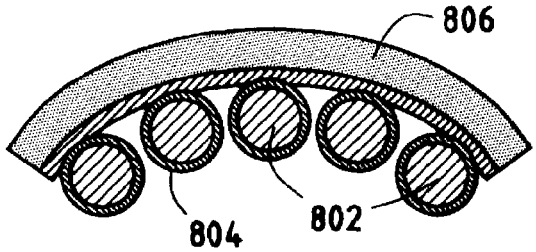

FIGS. 8*a* and 8*b* illustrate a cross-sectional view through the cable of FIG. 2 having a curvature along the length of this cable. The support layer 806 may be sufficiently flexible to permit the curvature shown in the figures. The embodiment of the cable shown in FIGS. 8*a* and 8*b* may be used in connection with a structure having a circular cross section such as tubing (casing) or a downhole tool for use in a borehole. The cables shown in the figures have a curvature defined by a radius that is substantially equal to a radius of the above-mentioned structures with circular cross section. This permits the cable to be mounted onto a surface of the above-mentioned structure, conforming to the shape of the surface of the structure, thus saving space in a borehole that may be already limited in size.

Figure 9:
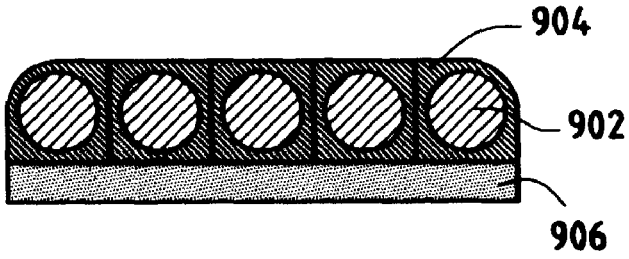
FIG. 9 illustrates a cross-sectional view through an alternative embodiment of the cable where the insulation encapsulating the conductors has a squared cross-section.

FIG. 9 illustrates a cross-sectional view through an alternative embodiment of the cable where insulation 904, encapsulating conductors 902, has a cross section having a shape that prevents migration of fluids between the insulation of conductors 202. The cross section of the insulation has a shape such that a lateral side thereof and the adjacent lateral side of an adjacent insulation (of an adjacent conductor) form an interface that prevents a fluid from migrating along the cable between the adjacent lateral sides. In the embodiment shown in FIG. 9, insulation 904 has a squared cross-section, though this insulation may also have a rectangular cross-section. As the cross section of the insulation has a squared shape or rectangular shape, no gap is left between each insulated conductor thereby preventing fluid migration along the cable. Fluid migration along the cable may be the result of a differential pressure existing between two reservoirs or two zones of one reservoir. The fluid at the higher pressure typically flows towards the fluid at the lower pressure through small channels or gaps that may subsist in cables where conductors do not have a squared shape, such as cables with conductors having a circular cross-section.

Figure 10:
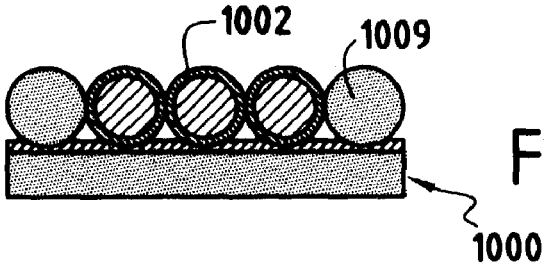
FIG. 10 illustrates a cross-sectional view through a cable according to the present invention that includes 2 dummy wires extending on each lateral side of the cable.

FIG. 10 illustrates a cross-sectional view through a cable 1000 that includes 2 dummy wires 1009 extending on each lateral side of cable 1000 along the array of conductors 1002. The dummy wires 1009 are utilized to protect conductors 1002 from external shock. These dummy wires may have smaller sizes and/or weight than the bumper cables of the prior art as cable 1000 utilizes the support layer 1006 that substantially supports conductors 1002.

Figure 11:
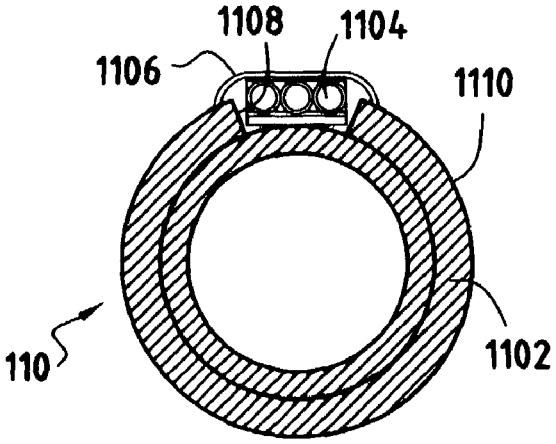
FIG. 11 illustrates a cross-sectional view through an assembly including a casing and a cable according to one embodiment of the present invention running along this casing.

FIG. 11 illustrates a cross-sectional view through an assembly including a casing 1102 used in a borehole having a cable 1104, according to one embodiment of the present invention, running along this casing. Casing 1102 may be used in an oil or gas well being fitted in a borehole. Casing 1104 has an outer surface 1110 with a recess 1108 running along the length of this outer surface. Cable 1104 is placed within the recess and is fastened to the casing by way of a clamp 1106 or any other practical fastening device.

Figure 12:
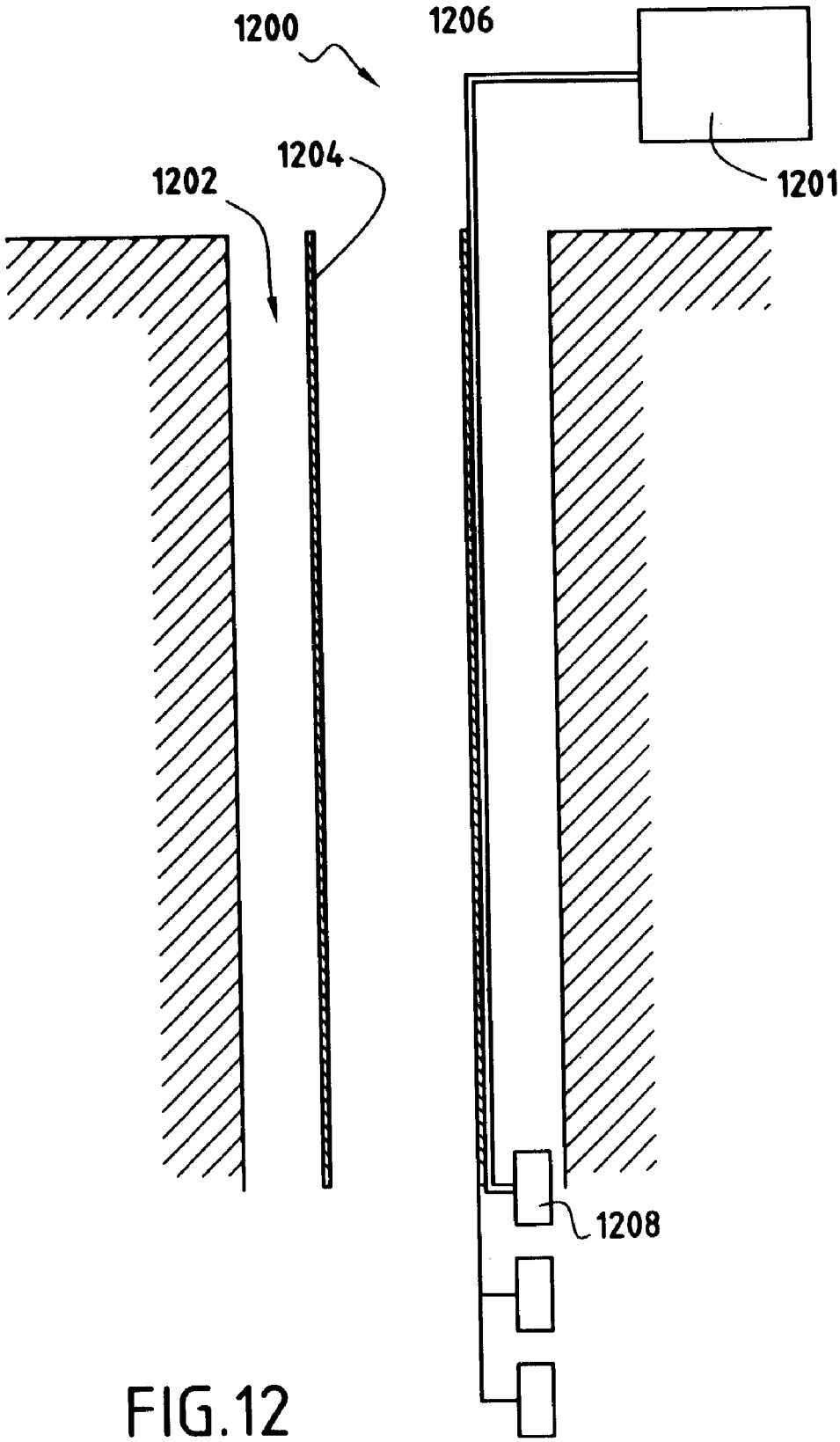
FIG. 12 illustrates a system used in downhole applications where the cable according to one embodiment of the present invention may be utilized.

FIG. 12 illustrates a system 1200 used in downhole applications where the cable according to one embodiment of the present invention may be utilized. System 1200 includes a measurement control unit 1201 located in proximity of the surface of an earth formation traversed by borehole 1202. The measurement control unit may typically include a power supply as well as a signal generation and processing device that may generate signals as well as process signals received from a downhole device 1208, located downhole. Within borehole 1202 is inserted casing 1204 that may be positioned concentrically with a tubing pipe (not shown) trough which oil may be extracted. A cable 1206 according to one embodiment of the present invention runs along the casing and is coupled at an upper end thereof to the measurement control unit 1201 and at a second end thereof, downhole, to downhole device 1208 which may be a sensor. The system may be utilized for Electrical Resistivity Array (ERA) measurements to determine the resistivity of the earth formation. For ERA measurements, each conductor of the cable is linked to a sensor.

While the cable described in this application may be used in downhole applications, this cable may equally be used in other applications requiring such cables.

The foregoing description of the embodiments of the present invention has been presented for purposes of illustration and description. It is not intended to be exhaustive or limit the invention to the precise form disclosed. Obviously, many modifications and variations will be apparent to those skilled in the art. The embodiments were chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. An electrical cable for use in a downhole application, the cable comprising:

a first elongated support layer providing mechanical strength, the electrical and physical properties of said first elongated layer remaining essentially unaffected by the absorption of fluids including oil, water and gas;

a second elongated support layer; and an array of insulated conductors bonded between said first and second elongated support layers, said first elongated support layer substantially bearing a weight of said conductors.

2. The cable of claim 1 wherein each of said insulated conductors includes a conductor and a insulation encapsulating said conductor.

3. The cable of claim 2 wherein said insulation is bonded between said first and second elongated support layers.

4. The cable of claim 1 wherein said first elongated support layer is non-conductive.

5. The cable of claim 2 wherein said insulation includes PEEK.

6. The cable of claim 5 wherein said first elongated support layer includes PEEK.

7. The cable of claim 6 wherein said first elongated support layer further includes fiberglass, or, Kevlar® fiber, or carbon fiber.

8. The cable of claim 2 further including an adhesive bonding said conductors between said first and second elongated support layers.

9. The cable of claim 2 wherein said insulation welded between said first and second elongated support layers.

10. The cable of claim 1 wherein said first elongated support layer withstands traction loads of approximately 500 Kg.

11. The cable of claim 1 wherein said conductors include copper.

12. The cable of claim 1 wherein said conductors withstand currents substantially equal to 1 Ampere.

13. The cable of claim 1 said cable having a weight substantially equal to ⅛ kilo per meter.

14. The cable of claim 1 further including a jacket formed onto the insulated conductors.

15. The cable of claim 2 wherein each insulation has a lateral side, where adjacent lateral sides of adjacent insulations form an interface that prevent a fluid from migrating along the cable between said adjacent lateral sides of adjacent insulations.

16. The cable of claim 15 wherein each insulation has a cross section having a squared shape or a rectangular shape.

* * * * *